US007377359B2

(12) United States Patent
Hofmann et al.

(10) Patent No.: US 7,377,359 B2
(45) Date of Patent: May 27, 2008

(54) DEVICE FOR MODULATING NOISE IN A MOTOR VEHICLE

(75) Inventors: Marcus Hofmann, Stuttgart (DE); Sascha Rossa, Baltmannsweiler (DE); Roudolf Starobinski, Hamburg (DE)

(73) Assignee: Daimler AG, Stuttgart (DE)

( * ) Notice: Subject to any disclaimer, the term of this patent is extended or adjusted under 35 U.S.C. 154(b) by 109 days.

(21) Appl. No.: 11/328,718

(22) Filed: Jan. 10, 2006

(65) Prior Publication Data

US 2007/0029133 A1 Feb. 8, 2007

Related U.S. Application Data

(63) Continuation-in-part of application No. PCT/EP2004/007498, filed on Jul. 8, 2004.

(30) Foreign Application Priority Data

Jul. 12, 2003 (DE) ..... 103 31 620

(51) Int. Cl.
*F01N 7/04* (2006.01)

(52) U.S. Cl. ..... 181/275; 181/238; 181/239; 181/249; 181/251; 181/255; 181/264; 181/268; 181/269; 181/272

(58) Field of Classification Search ..... 60/312; 181/238, 239, 249, 251, 255, 264, 268, 269, 181/272, 275
See application file for complete search history.

(56) References Cited

U.S. PATENT DOCUMENTS 2,356,782 A * 8/1944 Muller ..... 181/238
2,370,259 A * 2/1945 Rippingille ..... 60/313
2,573,474 A * 10/1951 Marx ..... 184/47
3,388,769 A * 6/1968 Martoia ..... 181/238
3,794,139 A * 2/1974 Hetherington et al. ..... 181/238
5,214,253 A * 5/1993 Houston, Jr. ..... 181/238
5,351,481 A * 10/1994 Flugger ..... 60/273
5,519,994 A * 5/1996 Hill ..... 60/313
5,979,583 A * 11/1999 Amino et al. ..... 180/219
6,530,452 B1 * 3/2003 Pettersson et al. ..... 181/251
6,732,510 B2 * 5/2004 Ciray ..... 60/312
6,796,402 B1 * 9/2004 Wagner ..... 181/238
6,912,843 B2 * 7/2005 Hufendiek et al. ..... 60/282
2001/0015301 A1 * 8/2001 Kesselring ..... 181/249

FOREIGN PATENT DOCUMENTS

DE 721 228 5/1942

(Continued)

*Primary Examiner*—Lincoln Donovan
*Assistant Examiner*—Jeremy Luks
(74) *Attorney, Agent, or Firm*—Klaus J. Bach

(57) ABSTRACT

In a device for noise configuration in a motor vehicle which has an internal combustion engine with at least two gas conduits connected to different cylinders of the engine, the gas conduits are interconnected by means of a cross-flow section formed by a housing which encloses the gas conduits and which has at least two chambers in each of which one of the gas conduits is disposed, each of the gas conduits being in communication with the respective chamber by which it is enclosed by means of a respective cross-flow opening and the two chambers being in communication with one another by means of at least one cross-flow opening which is remote from the cross-flow openings of the gas conduits so as to provide for a phase shift of the sound waves of the gas flowing through the housing.

8 Claims, 2 Drawing Sheets

FOREIGN PATENT DOCUMENTS

| | | |
|---|---|---|
| DE | 298 11 689 | 12/1999 |
| DE | 199 47 203 | 4/2001 |
| DE | 101 10 884 | 10/2001 |
| DE | 102 12 257 | 9/2002 |
| DE | 101 32 886 | 1/2003 |
| FR | 2 824 105 | 10/2002 |
| GB | 2 161 215 | 1/1986 |
| JP | 57 102508 | 6/1982 |

* cited by examiner

DEVICE FOR MODULATING NOISE IN A MOTOR VEHICLE

This is a continuation-in-part application of international application PCT/Ep2004/007498 filed Jul. 8, 2004 and claiming the priority of German application 103 31 620.5 filed Jul. 12, 2003.

BACKGROUND OF THE INVENTION

The invention relates to a device for noise configuration in a motor vehicle with an internal combustion engine having at least two exhaust conduits connected to different cylinders of the engine and having a cross-flow section each enclosed by a housing and the housings being in communication with each other by at least one cross-flow opening.

In internal combustion engines having twin-pipe exhaust systems, it is known to provide a so-called cross-flow section between these two exhaust pipes in order to allow resonance discharge of the internal combustion engine. Such engines are normally internal combustion engines having six, eight or twelve cylinders in a V arrangement.

As a result of the ignition sequence of internal combustion engines of this type and by the cross-flow of the exhaust gas from one exhaust pipe into the other, it is however to be observed by way of example that in the sound characteristic of a 6 cylinder internal combustion engine, the odd-numbered multiples of the $1.5^{th}$ engine order, so in particular the $1.5^{th}$ and the $4.5^{th}$ engine order, cancel each other out. Precisely these secondary orders are however necessary for a sporty noise, so that internal combustion engines in a V-layout with exhaust systems of this type frequently have a sound which is regarded by the driver as not sporty enough. This is also the case in a similar way for internal combustion engines having other numbers of cylinders.

In DE 102 12 257 A1, it is sought to eliminate the generally existing problem of an insufficiently sporty sound by means of a line which branches off from the intake duct and a hollow body which is arranged in this line and includes an element which can oscillate. This known device is effective, but it requires a relatively large outlay.

It is therefore an object of the present invention to provide a device for noise configuration in a motor vehicle which allows a cross-flow between the at least two gas conduits and yet provides for a sporty engine exhaust sound using simple means.

SUMMARY OF THE INVENTION

In a device for noise configuration in a motor vehicle which has an internal combustion engine with at least two gas conduits connected to different cylinders of the engine, the gas conduits are interconnected by means of a cross-flow section formed by a housing which encloses the gas conduits and which has at least two chambers in each of which one of the gas conduits is disposed, each of the gas conduits being in communication with the respective chamber by which it is enclosed by means of a respective cross-flow opening and the two chambers being in communication with one another by means of at least one cross-flow opening which is remote from the cross-flow openings of the gas conduits so as to provide for a phase shift of the sound waves of the gas flowing through the housing.

As a result of this arrangement of the cross-flow openings between the chambers relative to the openings of the at least two gas conduits, the exhaust flow continues to flow through the two exhaust pipes and leaves the exhaust system, so that, with the device according to the invention, resonance discharge of the internal combustion engine is possible in a simple manner without adversely affecting the power and consumption of the engine.

With the extended path that the sonic waves must cover as a result of the connection according to the invention of the two gas conduits, and the acoustic coupling of the latter achieved therby, a phase shift between the two flows and the sonic waves associated with them in the respective gas conduits is achieved, as a result of which, in the case for example of a six-cylinder internal combustion engine, the canceling of the odd-numbered multiples of the $1.5^{th}$ engine order is prevented. According to the invention, the odd-numbered multiples of the $1.5^{th}$ engine order, that is to say the secondary orders, are thus once again part of the sound characteristic of the internal combustion engine, so that, in spite of the presence of the cross-flow section, a sporty sound characteristic of the engine can advantageously be achieved. A similar effect, that is to say a corresponding canceling of certain engine orders, is prevented in internal combustion engines with other numbers of cylinders.

The invention also resides in a motor vehicle having an internal combustion engine with a device according to the invention.

Advantageous embodiments of the invention will become apparent from the following description of an exemplary embodiment on the basis of the accompanying drawings:

DESCRIPTION OF A PREFERRED EMBODIMENT

Figure 6:
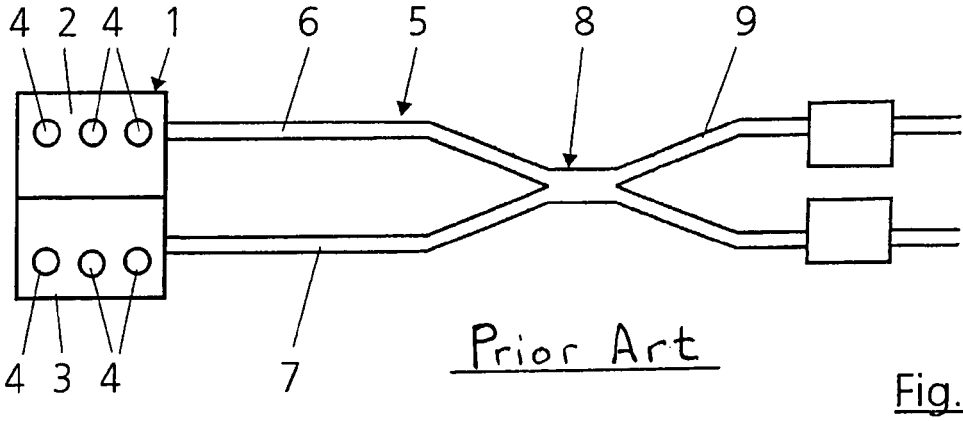
Prior Art Fig.6
FIG. 6 shows an internal combustion engine having a twin-pipe exhaust system and a cross-flow section between the two exhaust pipes according to the prior art.

FIG. 6 shows a highly schematic illustration of an internal combustion engine 1 for a motor vehicle (not illustrated) which in the present case has two cylinder banks 2 and 3 which each have three cylinders 4. An intake system (not illustrated) which has corresponding inlet lines and which can be of known construction leads to the internal combustion engine 1 which is in a V-layout.

The exhaust gases which are produced in the cylinders 4 of the internal combustion engine 1 leave the latter by means of the exhaust system 5 which has two exhaust pipes 6 and 7, assigned to the two cylinder banks 2 and 3, respectively. The two exhaust pipes 6 and 7 are connected to one another by means of a so-called cross-flow section 8 which allows resonance discharge of the cylinders 4 of the internal combustion engine 1. Since the function principle of the cross-flow section 8 and the resonance discharge which this allows are known per se, these are not described in any further detail in the following.

The cross-flow of the exhaust gases via the cross-flow section 8 from one exhaust pipe 6 to the other exhaust pipe 7 and vice versa and the specific ignition sequence of the internal combustion engine 1 in a V-layout result in certain frequencies or engine orders in the sound characteristic of the internal combustion engine 1 being cancelled out or at least approximately cancelled out. In the present case of the internal combustion engine 1 having six cylinders 4, it is the odd-numbered multiples of the $1.5^{th}$ engine order, that is to say the $1.5^{th}$, the $4.5^{th}$, the $7.5^{th}$ etc. engine orders, that are cancelled out and can thus no longer contribute to the sound characteristic of the internal combustion engine 1.

This problem could be eliminated or at least lessened by reducing the diameter in the region of the cross-flow section 8, but resonance discharge would then no longer be possible, so that the performance of the internal combustion engine 1 would decrease dramatically. There is therefore a trade-off in this region between good performance and an appealing sound characteristic of the internal combustion engine 1.

Figure 1:
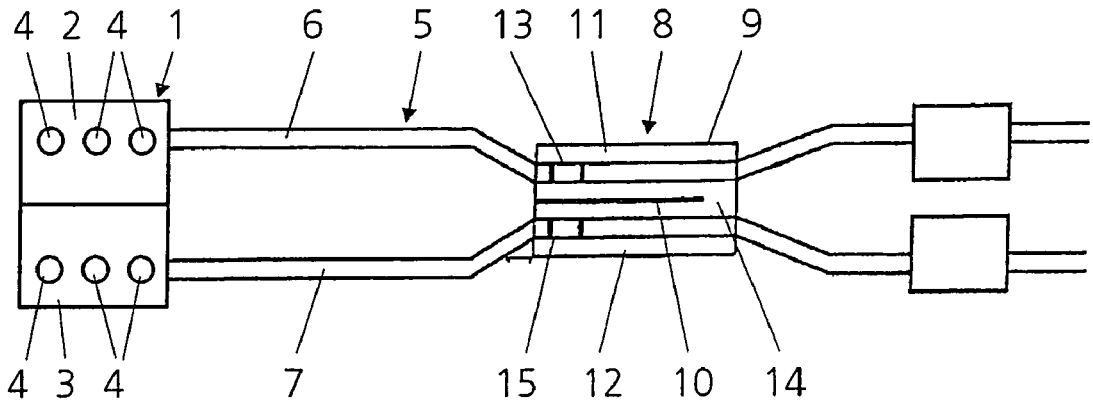
FIG. 1 shows an internal combustion engine having a twin-pipe exhaust system and a cross-flow section according to the invention between the two exhaust pipes.
Figure 2:
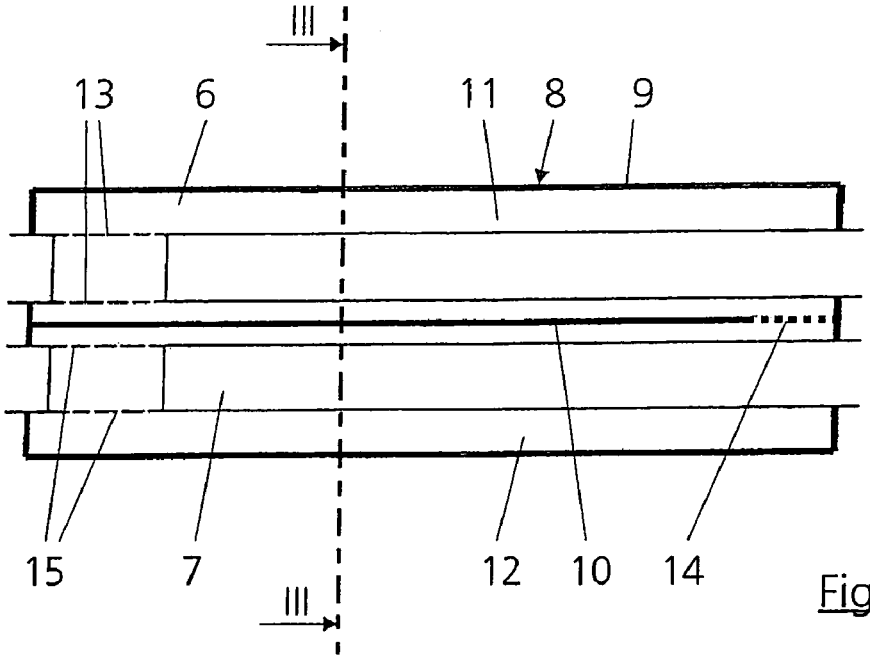
FIG. 2 shows an enlarged illustration of the cross-flow section shown in FIG. 1.
Figure 3:
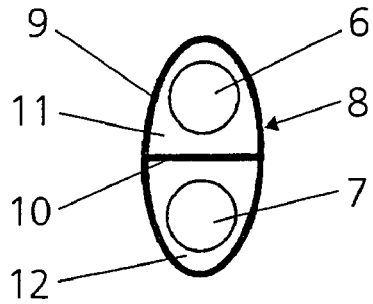
FIG. 3 shows a section through the housing cross-flow section taken along line III-III of FIG. 2.

In order to eliminate this conflict, the cross-flow section 8 in the case of the internal combustion engine 1 according to the invention is formed as illustrated in figures 1, 2 and 3. The cross-flow section area 8' includes a housing 9 which encloses the two exhaust pipes 6 and 7 and which is divided into two chambers 11 and 12 by a wall 10. The chamber 11 surrounds the exhaust pipe 6 and the chamber 12 surrounds the exhaust pipe 7. This can be seen more clearly in FIG. 3.

In order to allow a cross-flow from the exhaust pipe 6 to the exhaust pipe 7 and vice versa and thus resonance discharge of the internal combustion engine 1 in spite of the initially complete line separation of the two exhaust pipes 6 and 7, the exhaust pipe 6 is provided with a cross-flow opening 13 which leads to the chamber 11, and the exhaust pipe 7 is provided with a cross-flow opening 15 which opens to the chamber 12 and the two chambers 11 and 12 are connected to one another by means of a cross-flow opening 14 in the wall 10. In spite of this construction, the exhaust gas flow also flows on through the two exhaust pipes 6 and 7 and in this way leaves the exhaust system 5, resonance discharge of the internal combustion engine 1 being possible even with this cross-flow section 8 and an acoustic connection additionally being provided.

The longer distance that the exhaust gas flow is required to cover through this design of the cross-flow section 8 through the chambers 11 and 12 results in a phase shift between the two exhaust gas flows and the sonic waves associated with them in the two exhaust pipes 6 and 7, so that complete canceling of the odd-numbered multiples of the $1.5^{th}$ engine order, as described with reference to FIG. 6, is prevented. These odd-numbered multiples of the $1.5^{th}$ engine order are thus once again in the sound characteristic of the internal combustion engine 1, so that a sporty sound characteristic of the latter results even with the cross-flow section 8 being present. In this case, the cross-flow opening 14 is situated as far away as possible from the cross-flow openings 13 and 15 so that there is as great a distance as possible for the exhaust gas to cover within the chambers 11 and 12 and hence as great a phase shift as possible.

In the enlarged illustration in FIG. 2, it can be seen that the cross-flow openings 13 and 15 of the two exhaust pipes 6 and 7 to the chambers 11 and 12 are formed by perforated sections of the exhaust pipes 6 and 7. In a similar way, the cross-flow opening 14 in the wall 10 between the two chambers 11 and 12 is also formed in such a way that the wall 10 in this region is perforated or formed as a perforated metal plate.

Figure 4:
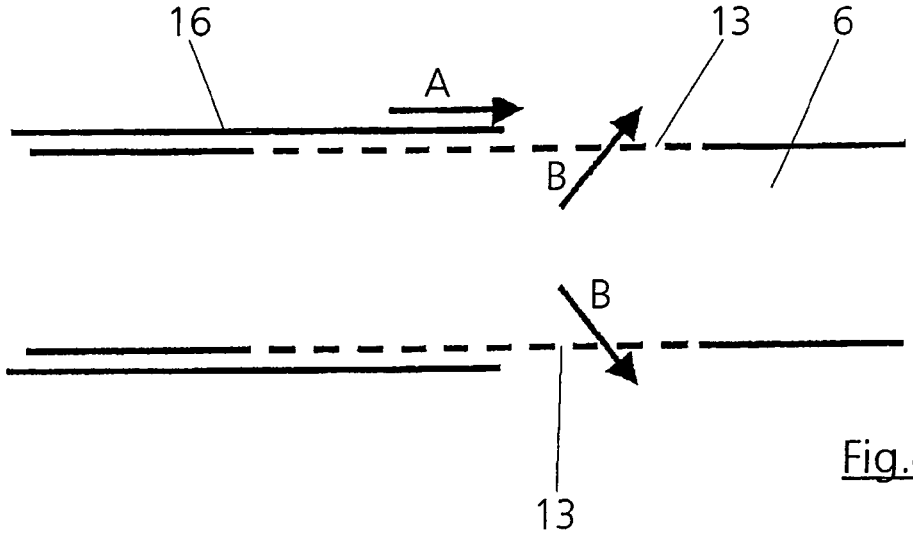
FIG. 4 shows a sleeve for at least partially closing off a cross-flow opening of one of the gas conduits in a first setting.
Figure 5:
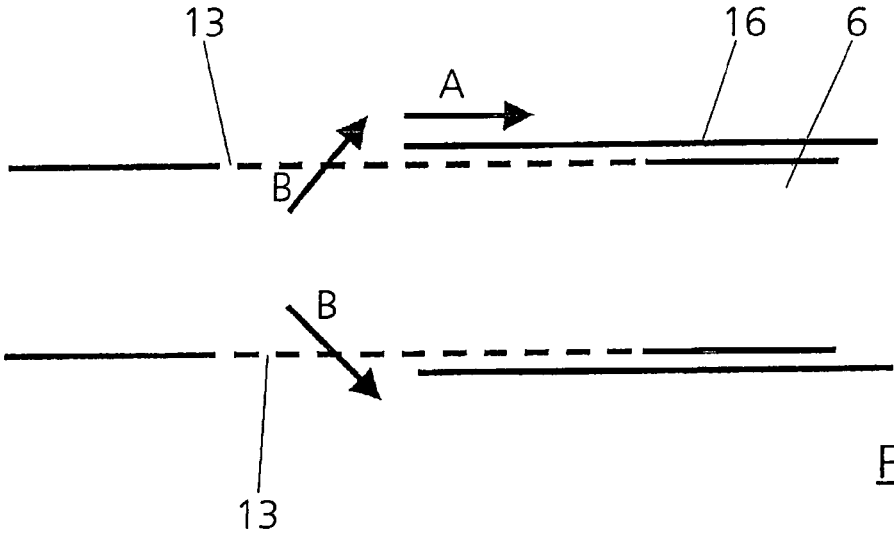
FIG. 5 shows the sleeve in FIG. 4 in a second setting.

In order to influence the sound characteristic of the internal combustion engine 1, a sleeve 16, as illustrated in highly schematic form in FIGS. 4 and 5, can be arranged around one or also around both of the exhaust pipes 6 and 7, which sleeve 16 is displaceable in the longitudinal direction of the respective exhaust gas pipe 6 or 7 according to the arrow A and can in this way at least partially close off the respective cross-flow opening 13 or 15 and thus restrict the exhaust gas flow indicated by the arrows B. As a result, both the amplitude and the phase position of the sonic waves assigned to the respective exhaust pipes 6 and 7 are influenced. It is also conceivable that the cross-flow opening 14 between the two chambers 11 and 12 can be at least partially closed off in a manner not illustrated, for example by means of a plate or similar, for influencing the sound characteristic of the internal combustion engine 1. Such adjustment of the cross-flow openings 13, 14 or 15 can also occur during operation of the internal combustion engine 1.

In the present case, the cross-flow section 8 is designed for the two exhaust pipes 6 and 7 as gas conduits, though the gas conduits could also be inlet lines which lead to the internal combustion engine 1 and which could be connected by means of the cross-flow section 8 which is designed in a similar or identical manner. The cross-flow section 8 could also theoretically be designed for more than two gas conduits.

What is claimed is:

1. A device for noise configuration in a motor vehicle which has an internal combustion engine (1) with at least two gas conduits (6, 7) connected to the engine (1), the at least two gas conduits (6, 7) being interconnected by means of a cross-flow section (8), the cross-flow section (8) including a housing (9) enclosing the at least two gas conduits (6, 7) and having at least two chambers (11, 12) divided by a separating wall (10) extending between the gas conduits (6, 7) over the full length of the housing (9), each of the at least two gas conduits (6, 7) extending longitudinally through one of the chambers (11, 12) and each of the gas conduits (6, 7) being in communication with the respective chamber (11, 12) in which it is disposed by means of a respective cross-flow opening (13,15) disposed at one longitudinal end of the housing (9), the chambers (11, 12) being in communication with one another by means of at least one cross-flow opening (14) arranged at the other end of the housing (9) remote from the cross-flow openings (13,15) of the gas conduits (6,7) so that there is a relatively large travel distance between the cross flow openings (13, 15) of the gas conduits (6, 7) and the crossflow opening (14) between the chambers (11, 12) for the gas within the chambers (11,12) in order to provide for a phase shift of gas Sound waves while permitting gas flow between the gas conduits (6, 7).

2. The device as claimed in claim 1, wherein the crossflow openings (13,15) of the gas conduits (6,7) to the associated chambers (11,12) are formed by means of perforations in the gas conduits (6,7).

3. The device as claimed in claim 1, wherein the cross-flow opening (14) between the at least two chambers (11, 12) is formed by means of a perforated section of a wall (10) which separates the two chambers (11, 12).

4. The device as claimed in claim 1, wherein means (16) are provided for at least partially closing the cross-flow openings (13 15) between the gas conduits (6, 7) and the associated chambers (11, 12).

5. The device as claimed in claim 4, wherein the means for at least partially closing the crossflow openings (13, 15) is a sleeve (16) which is displaceable along the gas conduits (6, 7).

6. The device as claimed in claim 1, wherein the crossflow opening (14) between the at least two chambers (11, 12) can be at least partially closed off.

7. The device as claimed in claim 1, wherein the gas conduits are exhaust pipes (6, 7).

8. The device as claimed in claim 1, wherein the gas conduits are air inlet lines.

* * * * *